US008923739B2

(12) United States Patent
Gon

(10) Patent No.: US 8,923,739 B2
(45) Date of Patent: Dec. 30, 2014

(54) FIXING DEVICE AND IMAGE FORMING APPARATUS INCLUDING THE SAME

(75) Inventor: Shoko Gon, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 791 days.

(21) Appl. No.: 13/080,839

(22) Filed: Apr. 6, 2011

(65) Prior Publication Data

US 2011/0243621 A1 Oct. 6, 2011

(30) Foreign Application Priority Data

Apr. 6, 2010 (JP) ..... 2010-087641
Feb. 21, 2011 (JP) ..... 2011-034535

(51) Int. Cl.
*G03G 15/00* (2006.01)
*G03G 15/20* (2006.01)

(52) U.S. Cl.
CPC ..... *G03G 15/2053* (2013.01)
USPC ..... 399/328; 399/329; 219/216

(58) Field of Classification Search
CPC ..... G03G 15/2053
USPC ..... 399/122, 328–330, 334; 219/216
See application file for complete search history.

(56) References Cited

U.S. PATENT DOCUMENTS 8,270,887 B2 * 9/2012 Uchiyama et al. ..... 399/329
8,306,467 B2 * 11/2012 Baba et al. ..... 399/329
8,369,761 B2 * 2/2013 Baba ..... 399/329
2005/0205555 A1 9/2005 Matsunaga et al.
2010/0215414 A1 * 8/2010 Uchiyama et al. ..... 399/329
2010/0215415 A1 8/2010 Baba
2011/0135356 A1 * 6/2011 Baba et al. ..... 399/329
2012/0243922 A1 * 9/2012 Uehara et al. ..... 399/329
2012/0243923 A1 * 9/2012 Uehara et al. ..... 399/329
2012/0251205 A1 * 10/2012 Nakao et al. ..... 399/329

FOREIGN PATENT DOCUMENTS

CN 101813907 A 8/2010
JP 2005-267950 A 9/2005
JP 2006-024491 1/2006
JP 2008-139432 A 6/2008
JP 2009-109648 A 5/2009
JP 2010002813 A * 1/2010 ..... G03G 15/20

OTHER PUBLICATIONS

Machine translation of JP 2010-002813. Original publication Jan. 7, 2010.*

* cited by examiner

*Primary Examiner* — David Gray
*Assistant Examiner* — Carla Therrien
(74) *Attorney, Agent, or Firm* — Frommer Lawrence & Haug LLP

(57) ABSTRACT

A fixing device includes a coil provided along an outer surface of a heating member to generate a magnetic flux for induction heating, a coil holding portion on which the coil is mounted, a core portion that forms a magnetic path around the coil and that includes arch cores that cover an outer side of the coil and are disposed opposite the heating member with the coil interposed therebetween and at a plurality of positions spaced in a recording-medium width direction and a side core that covers the outer side of the coil between the arch cores and the coil holding portion, and a core fixing member that presses the core portion toward the coil holding portion via an elastic member. The core portion is fixed in the pressing state to the coil holding portion by fastening the core fixing member to the coil holding portion.

20 Claims, 6 Drawing Sheets

FIXING DEVICE AND IMAGE FORMING APPARATUS INCLUDING THE SAME

INCORPORATION BY REFERENCE

This application is based upon and claims the benefit of priority from the corresponding Japanese Patent application No, 2010-087641, filed Apr. 6, 2010, and Japanese Patent application No. 2011-034535, filed Feb. 21, 2011, the entire contents of which are incorporated herein by reference.

FIELD

The present disclosure relates to a fixing device that fixes a toner image on a recording medium bearing the toner image by heating and fusing unfixed toner while passing the recording medium through a nip between a pair of fixing rollers or a nip between a heating belt and a roller, and to an image forming apparatus including the fixing device.

BACKGROUND

In recent image forming apparatuses of this type, a belt fixing method that allows setting of a low heat capacity has attracted attention in response to requests for reduction of warm-up time (a period from when the image forming apparatus is powered on to when a fixing device becomes ready to perform fixing) and energy saving in the fixing device. Also, an electromagnetic induction heating (IH) method capable of rapid heating and high-efficiency heating has attracted attention as a heating method adopted in the fixing device. From the viewpoint of energy saving in fixing of a color image, a large number of fixing devices utilizing the electromagnetic induction heating method and the belt fixing method in combination have been commercialized.

More specifically, a structure in which a coil for generating magnetic flux for electromagnetic induction is provided on the outside of a belt (so-called external IH) has been proposed in the electromagnetic induction heating method. In an electromagnetic induction heating apparatus that adopts the external IH, a coil is mounted on a coil bobbin. Further, a ferrite core portion is provided opposite to a heat roller with the coil and the coil bobbin sandwiched therebetween so as to form a magnetic path around the coil.

The above-described ferrite core portion is fixed to resin members, such as the coil bobbin on the inner side of the core portion and a core holder on the outer side of the core portion, with an adhesive such as a heat-resistant silicone adhesive. A layer of such an adhesive for fixing the core portion is resistant to high temperature during induction heating, and has the function of absorbing (e.g., compensating for or accommodating) production dimensional variation in the core portion. More specifically, the adhesive layer can absorb dimensional variation due to contraction caused when powder is pressed and sintered to form the core portion. Further, the adhesive layer can reduce vibration noise (chattering noise) from the core portion due to resonance of the core portion with high-frequency magnetic flux produced in the coil.

Nevertheless, as recognized by the present inventor, fixing with the adhesive is associated with various problems in production efficiency of the fixing device. For instance, the operation of applying the adhesive onto the coil bobbin and the core holder is itself inefficient. Moreover, some time is required for the adhesive to set, and space is required for storing the components with the adhesive applied thereon until the adhesive sets. The related art, however, does not particularly consider any solution to these problems.

SUMMARY

Accordingly, some embodiments according to the present disclosure are related to removing the operation of using an adhesive to fix a core portion of an electromagnetic-induction heating unit used in a fixing device. Various embodiments are related to a fixing device that includes a core portion that is fixed without the adhesive, and to an image forming apparatus including the fixing device.

A fixing device according to some aspects of the present disclosure fixes an image on a recording medium. The fixing device includes a coil disposed along an outer surface of a heating member and being operable to generate a magnetic flux for induction heating of the heating member; a coil holding portion on which the coil is mounted; a core portion configured to provide for a magnetic path around the coil, the core portion including arch cores that cover an outer side of the coil, the arch cores being disposed opposite the heating member with the coil interposed therebetween and at a plurality of positions spaced in a width direction of the recording medium and a side core that covers the outer side of the coil between the arch cores and the coil holding portion; and a core fixing member that is configured to press the core portion against the coil holding portion via an elastic member. The core portion is fixed in the pressing state to the coil holding portion by fastening the core fixing member to the coil holding portion.

In accordance with some embodiments, an image forming apparatus includes such a fixing device. The image forming apparatus includes an image forming section configured to form a toner image, a transfer unit configured to transfer the toner image termed by the image forming section to a recording medium, and the fixing device, which is configured to fix the toner image transferred by the transfer unit to the recording medium on the recording medium.

It is understood that the foregoing summary is representative of some embodiments of the disclosure, and is neither representative nor inclusive of all subject matter and embodiments within the scope of the present disclosure.

The above and other objects, features, and advantages of various embodiments of the present disclosure will be more apparent from the following detailed description of embodiments taken in conjunction with the accompanying drawings, in this text, the terms "comprising", "comprise", "comprises" and other forms of "comprise" can have the meaning ascribed to these terms in U.S. Patent Law and can mean "including", "include", "includes" and other forms of "include".

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and is by no way limiting the present disclosure, in fact, it will be apparent to those skilled in the art that various modifications, combinations, additions, deletions and variations can be made with respect to the herein embodiments without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Figure 1:
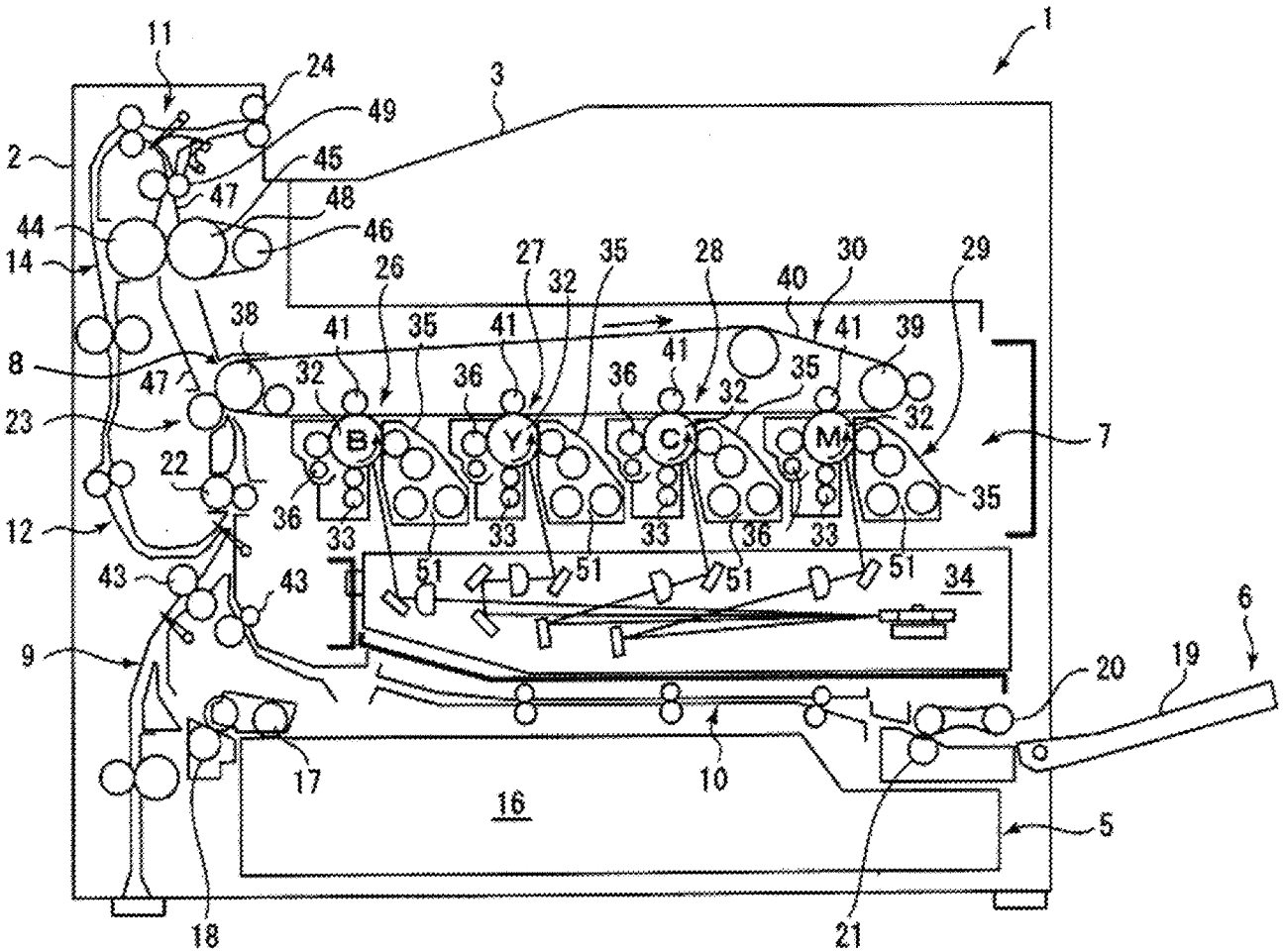
FIG. 1 is a schematic view illustrating a configuration of an image forming apparatus according to some embodiments.

FIG. 1 schematically illustrates a configuration of an image forming apparatus 1 according to some embodiments. The image forming apparatus 1 may be, for example, a printer, which is capable of performing printing by transferring a toner image onto a surface of a sheet of paper T as a recording medium on the basis of image information externally input, a copying machine, or a facsimile machine or a multi-functional peripheral that has the above functions in combination. In the following description of the illustrative embodiment, the recording medium is not limited to the sheet of paper T, and may be other recording media (e.g., an overhead projector (OHP) sheet).

The image forming apparatus 1 illustrated in FIG. 1 is a tandem color printer as an example. The image funning apparatus 1 includes an apparatus main body 2 shaped like a rectangular box in which a color image is formed (printed) on a paper T. On an upper surface of the apparatus main body 2, a discharge tray 3 is provided to receive a paper T on which a color image has been printed.

At the inner bottom of the apparatus main body 2, a paper feed cassette 5 that stores papers is provided. Further, a stack tray 6 is provided at a right lateral side of the apparatus main body 2 so as to feed papers T, which are not stored in the paper feed cassette 5, into the apparatus main body 2. An image forming section 7 is provided in an upper part of the apparatus main body 2, and forms a toner image on a paper T on the basis of image information, such as characters and pictures, transmitted from a host apparatus (e.g., a personal computer (PC)) connected to the image forming apparatus 1.

A first conveying path 9 through which a paper T fed out from the paper feed cassette 5 is conveyed to a below-described secondary transfer unit 23 is provided in a left part of the apparatus main body 2 in FIG. 1. A second conveying path 10 through which a paper T fed out from the stack tray 6 is conveyed to the secondary transfer unit 23 extends from a right part to the left part of the apparatus main body 2. Also, a fixing unit (fixing device) 14 and a third conveying path 11 are internally provided in an upper left part of the apparatus main body 2. The fixing unit 14 fixes a toner image on a paper T on which the toner image has been transferred by the secondary transfer unit 23. After fixing, the paper T is conveyed to the discharge tray 3 through the third conveying path 11.

In a state in which the paper feed cassette 5 is pulled out of the apparatus main body 2 (e.g., to the front side of the plane of FIG. 1), papers T can be replenished in the paper feed cassette 5. The paper feed cassette 5 includes a storage portion 16 that can selectively store one of at least two types of papers T having different sizes in the paper feed direction. When the image thrilling apparatus 1 performs image formation, papers T stored in the storage portion 16 are fed toward the first conveying path 9 one by one by a paper feed roller 17 and a pair of separating rollers 18.

The stack tray 6 can be opened and closed relative to an outer surface of the apparatus main body 2. Papers T are placed either one by one or together on a manual feed portion 19 of the stack tray 6. For image formation, papers T placed on the manual feed portion 19 are fed out into the second conveying path 10 one by one by a pickup roller 20 and a pair of separating rollers 21.

The first conveying path 9 and the second conveying path 10 join together on the upstream side of a pair of registration rollers 22. The conveyed paper t is temporarily stopped by contact with the pair of registration rollers 22, and is subjected to skew adjustment and timing adjustment. After that, the pair of registration rollers 22 start rotation, and the paper T is thereby conveyed toward the secondary transfer unit 23.

In the secondary transfer unit 23, a full-color toner image borne on an intermediate transfer belt 40 is secondarily transferred onto one side of the paper T conveyed toward the secondary transfer unit 23. After that, the toner image is fixed on the paper T by the fixing unit 14. As may be required, the paper T is reversed in a fourth conveying path 12, and a full-color toner image is also secondarily transferred on an opposite surface of the paper T in the secondary transfer unit 23. After the toner image is fixed on the opposite surface of the paper T by the fixing unit 14, the paper T with color images on both sides passes through the third conveying path 11, and is discharged to the discharge tray 3 by a pair of discharge rollers 24.

The image forming section 7 includes four image forming units 26, 27, 28, and 29 that respectively form toner images of black (B), yellow (Y), cyan (C), and magenta (M) colors. The image forming section 7 also includes an intermediate transfer unit 30 provided above the image forming units 26, 27, 28, and 29, and a laser scanning unit 34 provided below the image thrilling units 26, 27, 28, and 29. The intermediate transfer unit 30 temporarily bears the formed color toner images in a superimposed manner, and secondarily transfers the superimposed toner images onto the paper T. The laser scanning unit 34 irradiates below-described photoconductor drums (image carriers) 32 with laser beams modulated in accordance with image information about an image to be formed.

Each of the image forming units 26, and 29 includes a photoconductor drum 32, a charging unit 33, a de eloping unit 35, and a cleaning unit 36. The charging unit 33 opposes a peripheral surface of the photoconductor drum 32. The developing unit 35 opposes the peripheral surface of the photoconductor drum 32 on the downstream side of the charging unit 33 in the rotating direction of the photoconductor drum 32. The cleaning unit 36 opposes the peripheral surface of the photoconductor drum 32 on the downstream side of the developing unit 35 in the rotating direction of the photoconductor drum 32. A position on the peripheral surface of the photoconductor drum 32 irradiated by the laser scanning unit 34 is on the downstream side of a position on the peripheral surface of the photoconductor drums 32 opposing the charging unit 33 in the rotating direction of the photoconductor drum 32 and on the upstream side of a position on the peripheral surface of the photoconductive drum 32 opposing the developing unit 35 in the rotating direction of the photoconductor drum 32.

In each of the image forming units 26, 27, 28, and 29, the photoconductor drum 32 is rotated counterclockwise by a driving motor (not illustrated), as indicated by the arrow in FIG. 1. The developing unit 35 of each of the image forming units 26, 27, 28, and 29 includes a developing device 51 that stores a two-component developer containing one of the corresponding toners (black, yellow, cyan, and magenta tuners).

The intermediate transfer unit 30 includes a rear roller 38, a front roller 39, an intermediate transfer belt 40, and four primary transfer rollers 41. The rear roller 38 is provided near the image forming unit 26, and the front roller 39 is provided near the image forming unit 29. The intermediate transfer belt 40 extends over the rear roller 38 and the front roller 39. The primary transfer roller 41 in each of the image farming units 26, 27, 28, and 29 can be in pressing contact with the respective photoconductor drum 32 with the intermediate transfer belt 40 being disposed therebetween at a position on the downstream side of the respective developing unit 35 in the rotating direction of the respective photoconductor drum 32.

In the intermediate transfer unit 30, at the positions of the primary transfer rollers 41 corresponding to the respective image forming units 26, 27, 28, and 29, the toner images of the respective colors are transferred from the corresponding photosensitive drums 32 and superimposed on one another on the intermediate transfer belt 40, so that a full-color toner image is eventually formed on the intermediate transfer belt 40. The secondary transfer unit 23 and the intermediate transfer unit 30 constitute a transfer section 8.

The first conveying path 9 and the second conveying path 10 convey papers T fed from the paper feed cassette 5 and the stack tray 6, respectively, toward the secondary transfer unit 23, and include a plurality of pairs of conveying rollers 43 and a pair of registration rollers 22. The pairs of conveying rollers 43 are provided at predetermined positions in the apparatus main hod 2, and the pair of registration rollers 22 is provided on the upstream side of the secondary transfer unit 23. The pair of registration rollers 22 serves to adjust the timing of a paper feed operation with respect to an image forming operation in the image forming section 7.

The fixing unit 14 heats and pressurizes a paper T on which a toner image has been transferred in the image forming section 7, and thereby fixes the secondarily transferred toner image on the paper T. For example, the fixing unit 14 includes a pair of rollers, that is, a pressurizing roller (pressurizing rotating body) 44 and a fixing roller (fixing rotating body) 45. The pressurizing roller 44 includes, for example, a metal core, an elastic surface layer (e.g., formed of silicone rubber), and a release layer (e.g., formed of PFA: tetrafluoroethylene perfluoroalkoxy vinyl ether copolymer resin). The fixing roller 45 includes, for example, a metal core and an elastic surface layer (e.g., formed of silicone sponge). Also, a cylindrical heat roller (heating member) 46 is provided adjacent to the fixing roller 45 and on a side of the fixing roller 45 substantially opposite the pressurizing roller 44. A heating belt (heating member) 48 is wound around the heat roller 46 and the fixing roller 45. A detailed structure of the fixing unit 14, according to some embodiments, will be described below.

Conveying paths 47 are provided on the upstream and downstream sides of the fixing unit 14 in the paper conveying direction, respectively. A paper T conveyed through the secondary transfer unit 23 passes through the conveying path 47 on the upstream side, and is led into a fixing nip between the pressurizing roller 44 and the fixing roller 45. Then, the paper T passing through the fixing nip is guided to the third conveying path 11 through the conveying path 47 on the downstream side.

Through the third conveying path 11, the paper T that has been subjected to fixing by the fixing unit 14 is conveyed to the discharge tray 3. For this conveyance, a pair of conveying rollers 49 is provided, at an appropriate position in the third conveying path 11, and the above-described pair of discharge rollers 24 are provided at the exit of the third conveying path 11.

The fixing unit 14 included in the image forming apparatus 1 of the present illustrative embodiment will now be described in further detail. It will be understood that various values of approximate dimensions and/or parameters are provided simply by way of example for purposes of clarity, and are not intended to be limiting of the present disclosure.

Figure 2:
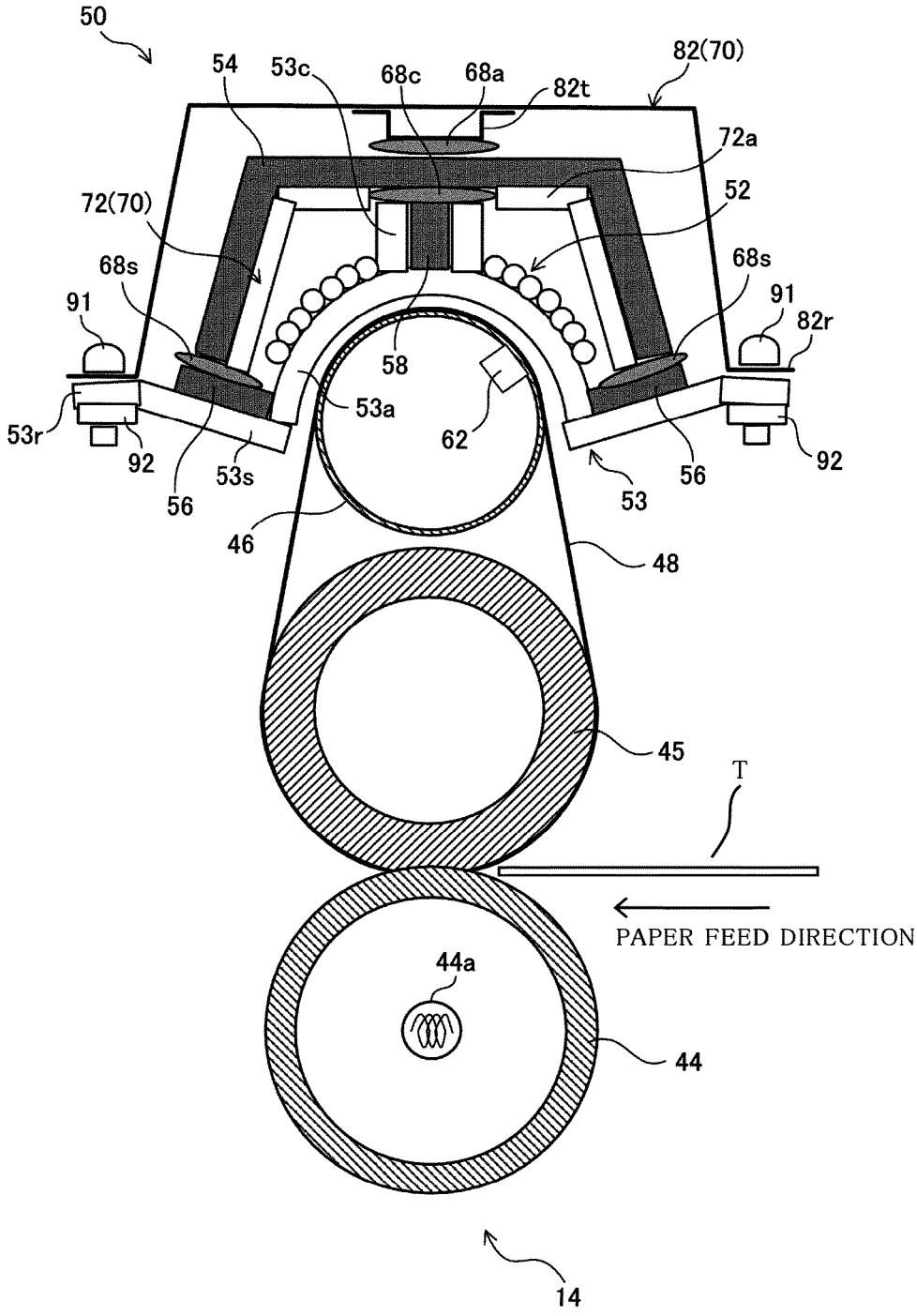
FIG. 2 is a cross-sectional view illustrating an exemplary structure of a fixing unit according to some embodiments.

FIG. 2 is a cross-sectional view illustrating a structure of the fixing unit 14 according to some embodiments. The fixing unit 14 illustrated in FIG. 2 is in an orientation rotated about 90° counterclockwise from an orientation in which the fixing unit 14 is mounted in the image forming apparatus 1. Therefore, while the paper conveying direction is upward in FIG. 1, it is leftward hi FIG. 2. In some implementations, the fixing unit 14 may be mounted in the orientation illustrated in FIG. 2; for example, this orientation may be well suited when the apparatus main body 2 has a larger size (e.g., when the image forming apparatus 1 is a multi-functional peripheral). Alternatively, the fixing unit 14 may be mounted in the apparatus main body 2 in a position inclined to the right or left from the orientation of FIG. 2.

As described above, the fixing unit 14 of the present embodiment includes the pressurizing roller 44, the fixing roller 45, the heat roller 46, and the heating belt 48. The pressurizing roller 44 is, for example, a roller having a diameter of about 50 mm, in which a silicone rubber layer having a thickness of about 2 mm to about 5 mm is provided on a metal core (e.g., made of stainless used steel (SUS)) and a release layer (e.g., made of PFA) is further provided on a surface of the silicone rubber layer. The fixing roller 45 is, for example, a roller having a diameter of about 45 mm, in which a silicone rubber sponge layer having a thickness of about 5 mm to about 10 mm is provided on a metal core (e.g., made of SUS).

The heat roller 46 includes, for example, a metal core made of a magnetic metal (e.g., iron) and having a diameter of about 30 mm and a thickness of about 0.2 mm to about 1.0 mm, and a release layer (e.g., made of PFA) provided on a surface of the metal core. The heat roller 46 is rotated by rotation of a shaft (not shown).

The heating belt 48 includes, for example, a base material comprising a ferromagnetic material and having a thickness of, for example, 35 μm (1 μm=$1\times10^{-6}$ m)(e.g., an electroformed nickel (Ni) base material), a thin-film shaped elastic layer (e.g., made of silicone rubber) provided on a surface of the base material and having, a thickness of about 200 μm to about 500 μm, and a release layer (e.g., made of PFA) provided on an outer surface of the elastic layer. The heat-generating temperature of the heating belt 48 may be controlled to be within a range of about 150° C. to about 200° C., by way of example. The heating belt 48 is an endless belt having a diameter of about 65 mm. If the heating belt 48 is not provided with a heating function, it may be made of resin such as polyimide (PI).

Since the fixing roller 45 has the elastic layer of silicone rubber sponge on the surface side, as described above, a flat fixing nip is formed between the heating belt 48 and the pressurizing roller 44. The pressurizing roller 44 is shaped like a hollow cylinder, and a halogen heater 44*a* is provided in an inner space of the pressurizing roller 44.

In addition, the fixing unit 14 includes an IH coil unit 50 on an outer side of the heat roller 46 and the heating bell 48 (not illustrated in FIG. 1). The IH coil unit 50 includes an induction heating coil 52 and a core portion. More specifically, the core portion includes a plurality of arch cores 54, a pair of side cores 56, and a center core 58.

In the example of FIG. 2, to perform induction heating at arc-shaped portions, in cross section, of the heat roller 46 and the heating belt 48, which oppose the IH coil unit 50, the induction heating coil (coil) 52 is provided on an imaginary arc in cross section extending along the arc-shaped outer surface portion of the heat roller 46 in cross section. Also, a coil bobbin (coil holding portion) 53 is provided on the outer side of the heat roller 46 and the heating belt 48, and the induction heating coil 52 is in the form of a winding on the coil bobbin 53. The coil bobbin 53 has a semicylindrical portion in cross section provided along the out surface of the heat roller 46. The coil bobbin 53 is preferably formed of a heat-resistant resin (e.g., PPS: polyphenylene sulfide resin, PET: polyethylene terephthalate resin, or LCP: liquid crystal polymer resin). The coil 52 is fixed to the coil bobbin 53 with, for example, a heat-resistant adhesive silicone adhesive).

Figure 3:
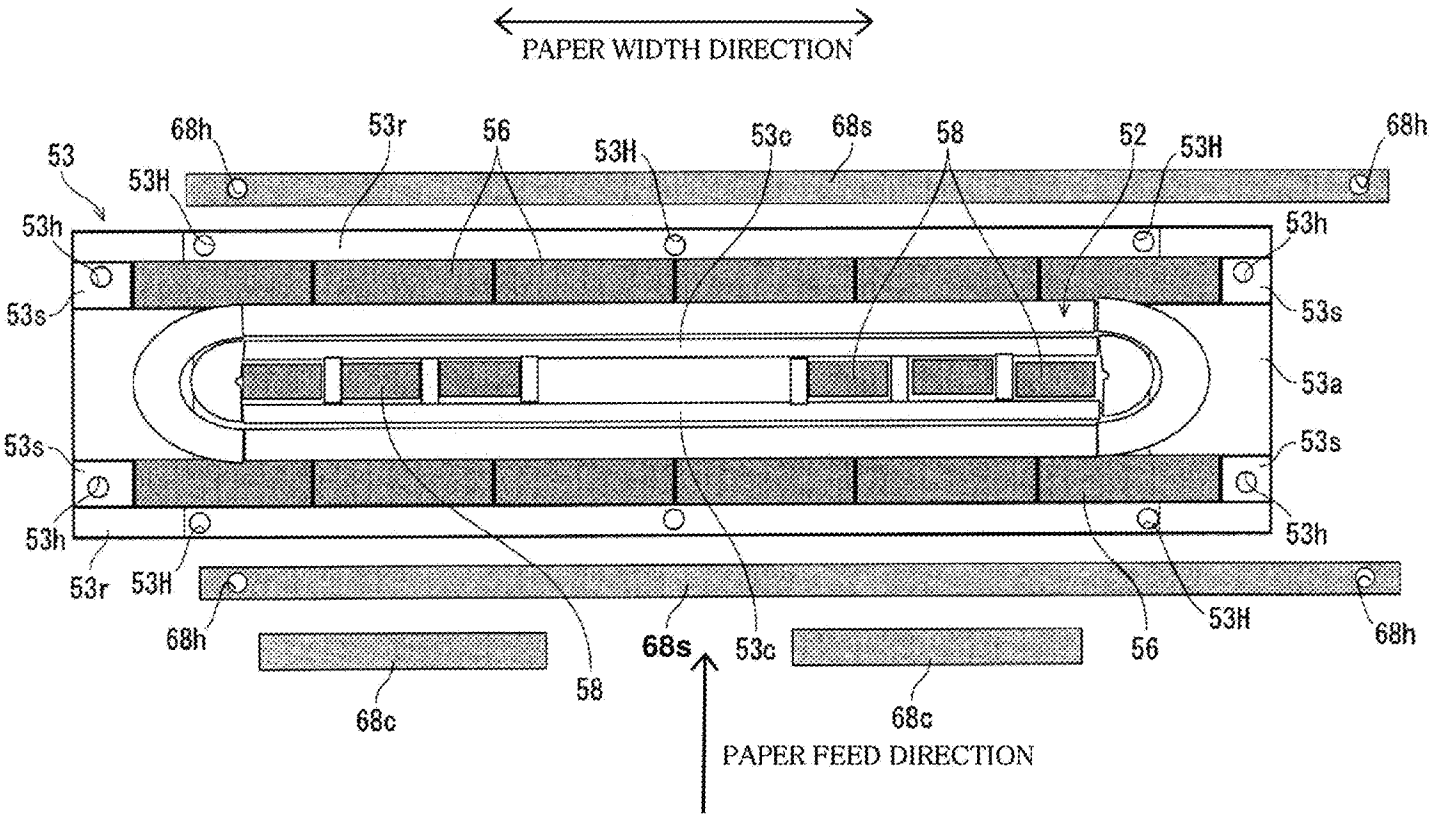
FIG. 3 is a plan view illustrating a state in which a shield cover and an arch core holder are removed from an IH coil unit illustrated in FIG. 2, in accordance with some embodiments.

Referring to FIG. 3, the center core 58 is provided in the center of the IH coil unit 50. The arch cores 54 and the side cores 56 described above are arranged in pairs on both sides of the center core 58. The arch cores 54 are ferrite cores that are shaped symmetrically with respect to the center core 58 and have an arch-shaped cross section. For example, the arch cores 54 are long in top view in a direction orthogonal to the longitudinal direction of a below-described core fixing member 70 (FIG. 4), that is, in the paper conveying direction, and cover an area where the induction heating coil 52 is provided.

Figure 4:
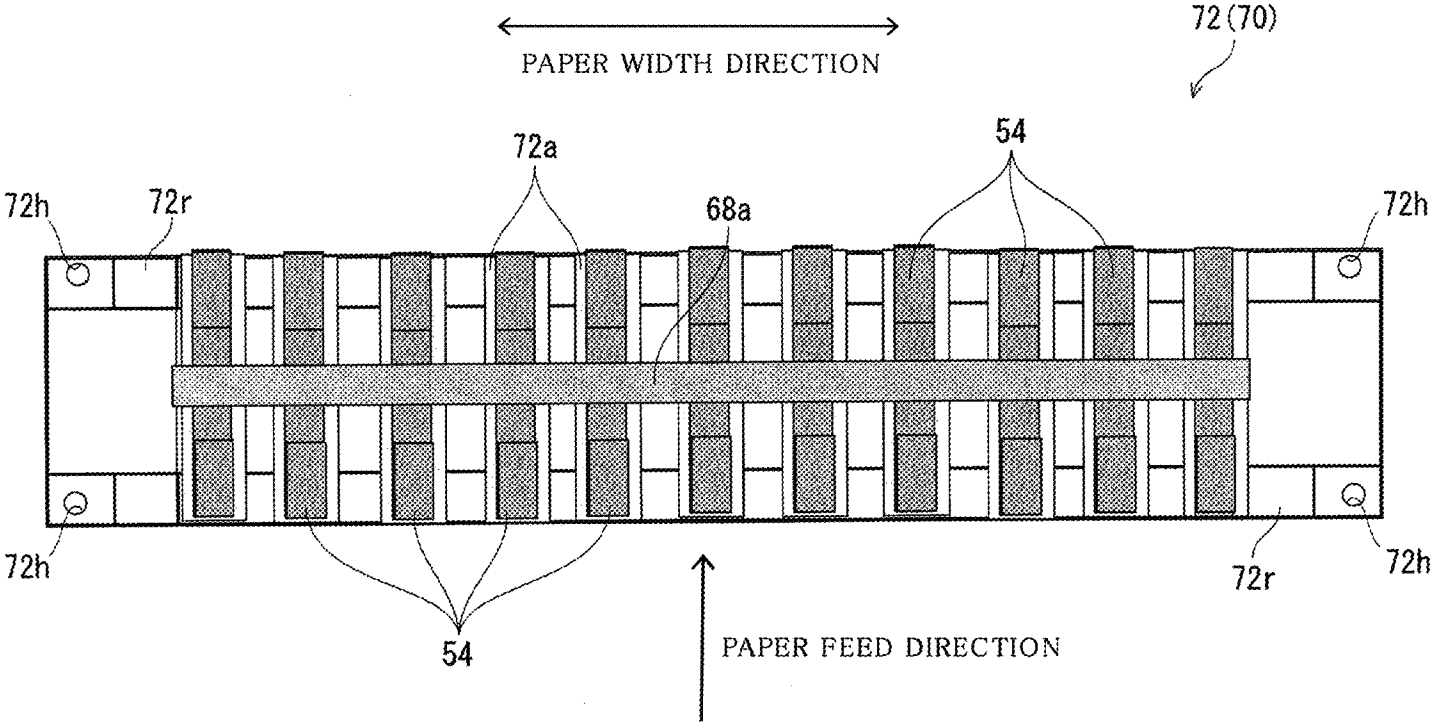
FIG. 4 is a plan view of the arch core holder illustrated in FIG. 2, in accordance with some embodiments.

The arch cores 54 are provided at as plurality of positions spaced in the longitudinal direction of a below-described arch core holder 72 (FIG. 4). FIG. 4 is a plan view of the arch core holder 72 illustrated in FIG. 2. In the present embodiment, the with of the arch cores 54 in the paper with direction (width in the longitudinal direction of the arch core holder 72) is about 10 mm. As the arrangement density of the arch cores 54 in the paper width direction increases, the magnetic-flux induction performance increases. However, the decrease in magnetic-flux induction performance is small even if the arrangement density of the arch cores 54 is decreased to some extent. Hence, the arrangement density of the arch cores 54 may be set such that sufficient performance can be achieved cost effectively. Further, the temperature distribution of the heating belt 48 in the axial direction can be adjusted by adjusting the arrangement density of the arch cores 54. In the present embodiment, for example, the arrangement density of the arch cores 54 is set such that the area occupied by the arch cores 54 is about one half to about one third of the entire area where the arch cores 54 can be provided. In addition, the arrangement density of the arch cores 54 at both longitudinal ends of the heating belt 48 may be set higher than near the center, thereby suppressing or preventing a decrease in temperature of the heating belt 48 at the longitudinal ends.

In the present illustrative embodiment, the side cores 56 on both sides are block-shaped ferrite cores. In accordance with various embodiments, the side cores 56 are connected to one end (lower end in FIG. 2) of each of the arch cores 54 without using any adhesive, as will be further described below, and are arranged on the coil bobbin 53 similarly without using any adhesive. Similarly to the arch cores 54, the side cores 56 cover the area where the induction heating coil 52 is provided.

Each side core 56 is divided into a plurality of parts, and the length of one part in the paper width direction is about 30 to about 60 mm. A plurality of parts of the side cores 56 are arranged in succession in the longitudinal direction of the heating belt 48 without any interval therebetween (FIG. 3). FIG. 3 is a plan view illustrating a state in which a shield cover 82 and the arch core holder 72 are removed from the IH coil unit 50 illustrated in FIG. 2. The overall length of an area where the side cores 56 are arranged corresponds to the length of the area where the induction heating coil 52 is provided. By thus arranging the parts of the side cores 56 in succession without any interval therebetween, variations in the temperature distribution associated with the arrangement of the arch cores 54 can be decreased. The arrangements of the arch cores 54 and the side cores 56 are determined, for example, in consideration of the magnetic flux density (magnetic field strength) of the induction heating coil 52. Since the arch cores 54 are arranged at certain intervals, the side cores 56 complement or reinforce the magnetic flux concentrating effect in places where the arch cores 54 are not provided, so that the magnetic flux density distribution (and hence the temperature distribution) may be evened out or equalized in the longitudinal direction of the heating belt 48.

A shield cover 82 formed of metal (e.g., aluminum) is provided on the outer side of the arch cores 54 and the side cores 56 (on a side of the arch cores 54 and the side cores 56 opposite the induction heating coil 52 (FIGS. 2 and 5)). As will be described below, the shield cover 82 allows the arch cores 54 and the side cores 56 to be supported on the coil bobbin 53.

In accordance with some embodiments, such as the illustrative embodiment of FIG. 2, the center core 58 may be a ferrite core of, for example, rectangular cross section. In the present embodiment, the center core 58 is connected to the arch cores 54 (center portions of the arch cores 54 in FIG. 2) without using any adhesive, as will be further described below, and is placed on the coil bobbin 53 similarly without using any adhesive. In some embodiments, the center core 58 may be provided (e.g., formed) integrally with the arch cores 54.

In the example of FIG. 2, a thermistor 62 is provided inside the heat roller 46. The thermistor 62 is located inside a portion of the heat roller 46 where the amount of heat generated by induction heating is particularly large. Alternatively or additionally, a non-contact sensor that detects the outer surface temperature of the heating belt 48 can be provided below the IH coil unit 50.

As described above, in the present illustrative embodiment, the arch cores 54, the side cores 56, and the center core 58 are fixed to the coil bobbin 53 without using any adhesive. That is, in accordance with some embodiments, the arch cores 54, the side cores 56, and the center core 58 are fixed in pressing contact with the coil bobbin 53 by fastening the core fixing member 70 to the coil bobbin (coil holding portion) 53.

More specifically, as illustrated in FIG. 2, the coil bobbin 53 of the present embodiment includes a coil support portion 53*a* of semicylindrical cross section. The induction heating coil 52 is provided on an upper surface of the coil support portion 53*a*, and center-core support portions 53*c* stand on a portion of the upper surface of the coil support portion 53*a* on the inner side of the induction heating coil 52 (also see FIG. 3). Each of the center-core support portions 53*c* extends in the longitudinal direction of the coil bobbin 53. The center core 58 is positioned by being clamped between the center-core support portions 53*c*. In the present illustrative embodiment, the center core 58 is divided into a plurality of parts in order to avoid uneven heat generation distribution of the heat roller 46 and the heating belt 48 in the longitudinal direction, more specifically, to prevent reduction in temperature near the ends of the heating belt 48. The parts of the center core 58 are arranged outside a paper passing area of the minimum size of paper T. The paper passing area refers to an area where the corresponding size of paper T can pass through in the fixing nip.

Further, side-core support portions 53*s* are sided on the upstream and downstream sides of the coil support portion 53*a* in the paper conveying direction. The side-core support portions 53*s* also extend in the longitudinal direction of the coil bobbin 53, and the side cores 56 are placed on the side-core support portions 53*s*. Screw holes 53*h* used for connection to the below-described arch core holder 72 are provided in appropriate positions of the side-core support portions 53*s* (FIG. 3).

Further, as illustrated in FIG. 3, connecting portions 53*r* are connected to the side-core support portions 53*s*. Screw holes 53H are also provided in appropriate positions of the connecting portions 53*r*, and are used to connect the connecting portions 53*r* to the below-described shield cover 82.

The core fixing member 70 of the present embodiment includes the arch core holder 72 and the shield cover 82.

As illustrated in FIG. 4, the arch core holder 72 has arch-core support portion 72*a*. Similarly to the arch cores 54 extending in the paper conveying direction, the arch-core support portion 72*a* are symmetrical with respect to the center core 58, and are arch-shaped in cross section. The arch-core support portion 72*a* clamp the right, left, and lower sides of the arch cores 54, and both ends in the paper conveying direction (lower ends in FIG. 2) thereof oppose upper surfaces of the side cores 56. The both ends of the arch-core support portion 72*a* extend in the longitudinal direction of the coil bobbin 53 and are connected to connecting portions 72*r*. The connecting portions 72*r* have screw holes 72*h* opposing the screw holes 53*h* of the coil bobbin 53 (side-core support portions 53*s*).

Figure 5:
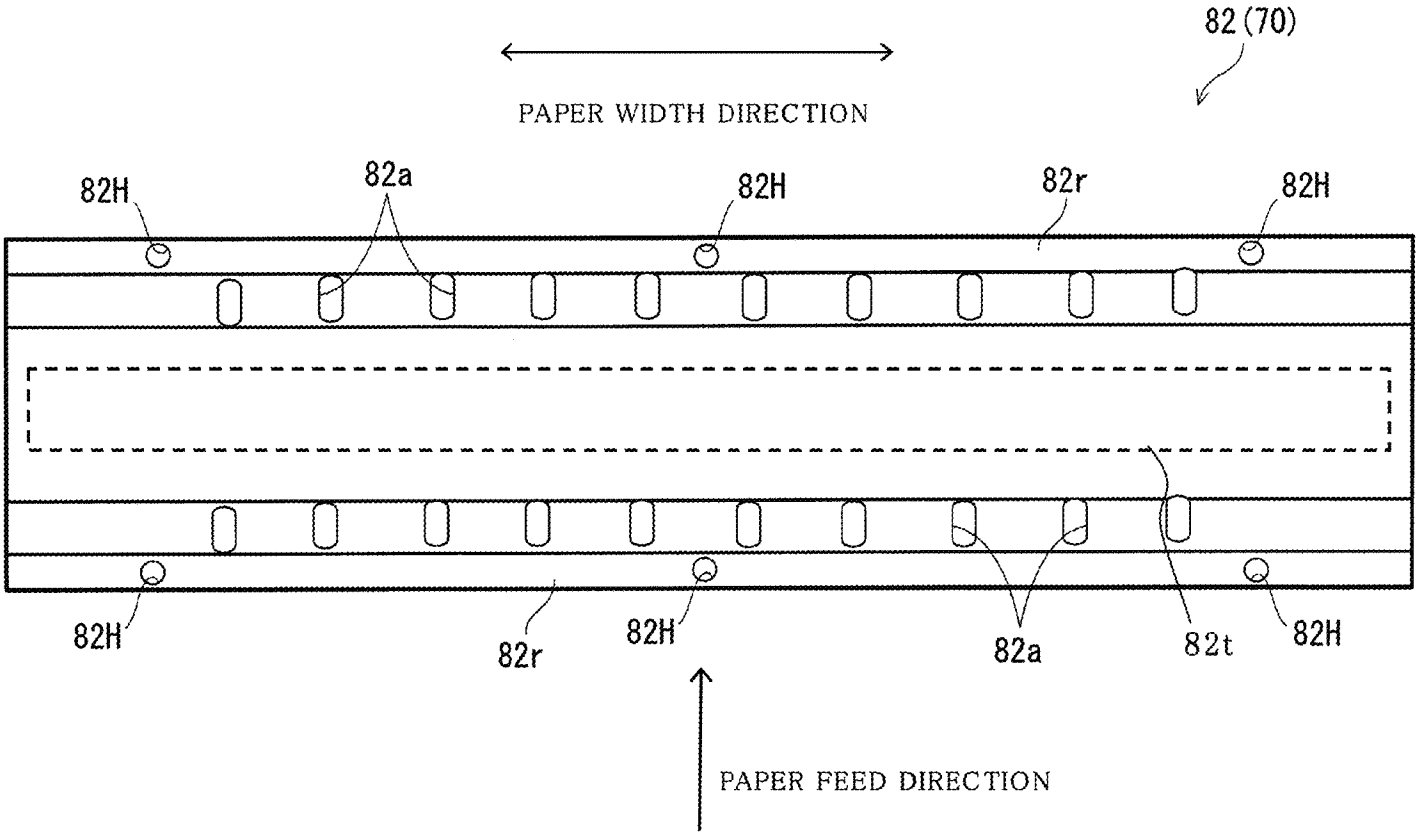
FIG. 5 is a plan view of the shield cover illustrated in FIG. 2, in accordance with some embodiments.

FIG. 5 is a plan view of the shield cover 82 illustrated in FIG. 2. As illustrated in FIG. 5, the shield cover 82 has connecting portions 82*r* to be in contact with the connecting portions 53*r* of the coil bobbin 53. The connecting portions 82*r* have screw holes 82H opposing the screw holes 53H of the coil bobbin 53. The shield cover 82, has a size such as to cover the connecting portions 53*r* and the coil bobbin 53 in the longitudinal direction so that the magnetic flux generated in the IH coil unit 50 does not leak out of the IH coil unit 50. Vent holes 82*a* are provided in appropriate positions of the shield cover 82. Through the vent holes 82*a*, cooling air from a fan (not illustrated) is blown toward the induction heating coil 52, thereby cooling the induction heating coil 52.

As illustrated in FIGS. 2 and 5, a projecting portion 82*t* is provided between the upstream vent holes 82*a* and the downstream vent holes 82*a* in the paper conveying direction on an inner surface of the shield cover 82. More specifically, the projecting portion 82*t* projects toward the tops of the arches of the arch cores 54 (corresponding to the position of the center core 58), and extends in the longitudinal direction of the shield cover 82. The projecting portion 82*t* is used to fix the arch cores 54.

In accordance with some embodiments, such as the present embodiment as illustrated in FIG. 2, elastic members 68*s*, 68*c*, and 68*a* are disposed between the side cores 56 and both of the arch cores 54 and the arch core holder 72, between the center core 58 and the arch cores 54, and between the arch cores 54 and the shield cover 82, respectively.

Specifically, the elastic members 68*s* (two in total) are disposed between the side cores 56 and both of the arch cores 54 and the arch core holder 72, and are used to fix the side cores 56 to the coil bobbin 53 in the pressing state.

More specifically, as illustrated in FIG. 3, the length of the elastic members 68*s* is greater than the overall length of the continuous side cores 56 (the overall length of the area where the arch cores 54 can be provided). Both longitudinal ends of the elastic members 68*s* have screw holes 68*h* that oppose the screw holes 53*h* of the coil bobbin 53.

Next, the elastic members 68*c* (two in total) are disposed between the center core 58 and the arch cores 54. The elastic members 68*c* have a length corresponding to the total length of a plurality of parts of the center core 58 provided outside the paper passing area of the minimum size of paper T. The elastic members 68*c* are used to fix the center core 58 to the coil bobbin 53 in the pressing state. In various embodiments where center core 58 may be formed integrally with arch cores 54, elastic members 68*c* would not be included.

The elastic member 68*a* (only one) is disposed between the arch cores 54 and the shield cover 82. As illustrated in FIG. 4, the elastic member 68*a* has a length such as to cover all arch cores 54 arranged in the longitudinal direction of the arch core holder 72. The elastic member 68*a* is pressed by the projecting portion 82*t* of the shield cover 82 so as to fix the arch cores 54 to the coil bobbin 53 in the pressing state.

For example, the elastic members 68*s*, 68*c*, and 68*a* are formed of a heat-resistant silicone rubber or felt material having a thickness of about 1 mm. In accordance with some embodiments, the elastic members 68*s*, 68*c*, and 68*a* can be compressed by about 0.2 mm to about 0.5 mm in the pressing state. The amount of compression can be adjusted by the engagement length between screws 91 and nuts 92 that will be described below.

An illustrative procedure for assembling the coil unit 50 of the present embodiment will be described with reference to FIG. 2. To assemble the IH coil unit 50 of the present embodiment, the side cores 56 and the center core 58 are firstly set on the coil bobbin 53, and the elastic members 68*s* and the elastic members 68*c* are then placed on the side cores 56 and the center core 58, respectively.

Next, the arch core holder 72 is put thereon from above, and screws (not illustrated) are inserted into the screw holes 53*h*, 68*h*, and 72*h* and are fastened by nuts (not illustrated). Thus, one-side ends (lower ends in FIG. 2) of the arch core holder 72 press the side cores 56 toward the coil bobbin 53 via the elastic members 68*s*, and the top of the arch of the arch core holder 72 presses the center core 58 toward the coil bobbin 53 via the elastic members 68*e*. Hence, the side cores 56 and the center core 58 are fixed to the coil bobbin 53 in the pressing state.

Next, after the arch cores 54 are set in the arch core holder 72, the elastic member 68*a* is placed on the tops of the arch cores 54, the shield cover 82 is put thereon, and screws 91 are inserted in the screw holes 53H and 82H and are fastened by nuts 92. Thus, the projecting portion 82*t* of the shield cover 82 presses the arch cores 54 toward the coil bobbin 53 via the elastic member 68*a*. Hence, the arch cores 54 are fixed to the coil bobbin 53 in the pressing state via arch core holder 72.

In addition, since the shield cover 82 is fastened to the coil bobbin 53 by the screws 91 and the nuts 92, the pressing three from the projecting portion 82*t* is transmitted to the arch cores 54 and the arch core holder 72, and is also transmitted to the side cores 56 and the center core 58 via the arch core holder 72, the elastic members 68*s*, and the elastic members 68*c*.

Figure 6:
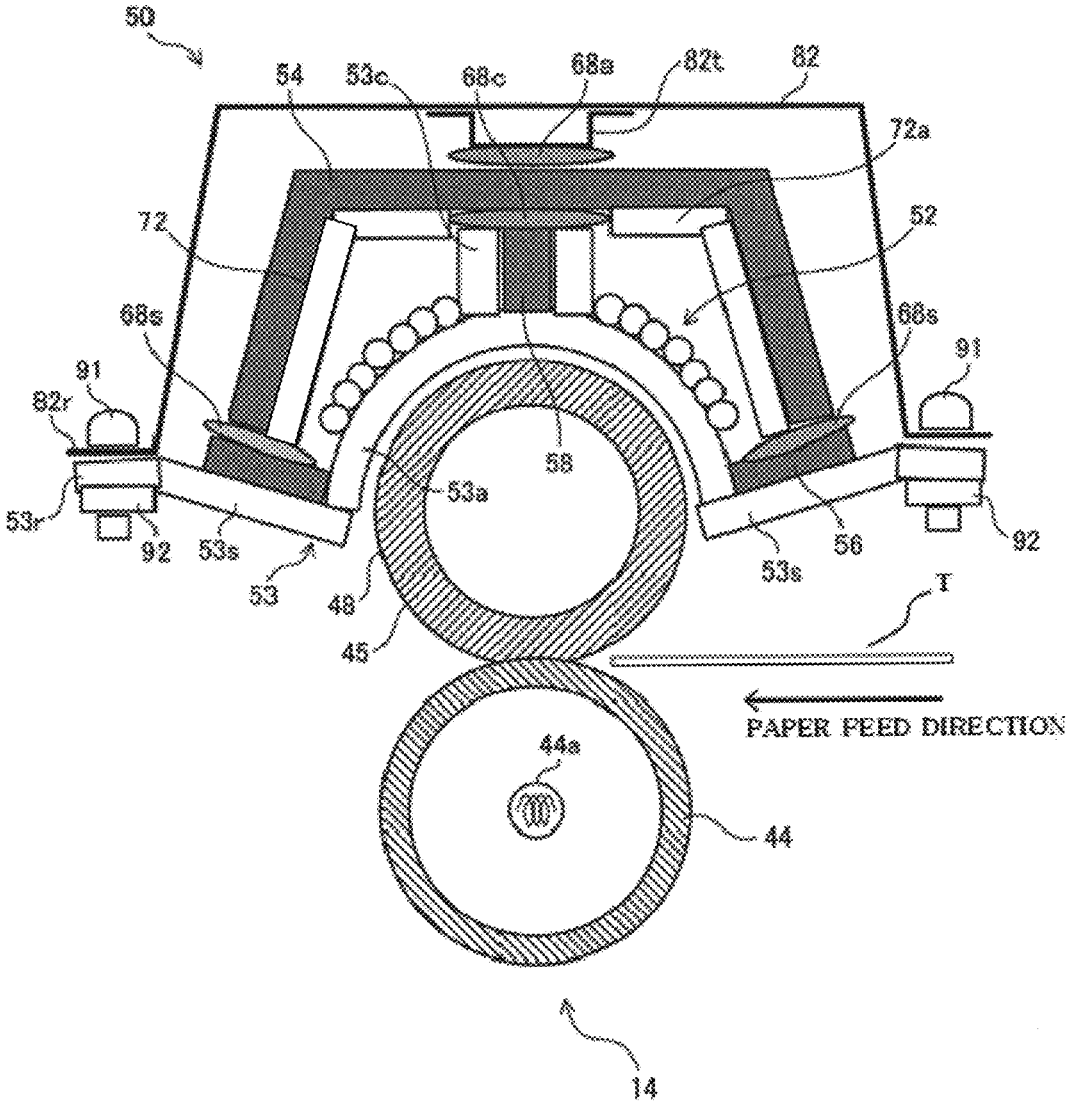
FIG. 6 is a cross-sectional view illustrating another exemplary structure of a fixing unit according to some embodiments.

While the two-axis structure in which the fixing roller 45 and the heat roller 46 are arranged on the inner side of the heating belt 48 is adopted in the above embodiment, embodiments in accordance with the present disclosure are also applicable to a single-axis structure, such as the illustrative embodiment depicted in FIG. 6. Structures having the same functions as those adopted in the above embodiment are denoted, by the same reference numerals, and descriptions thereof are omitted. According to an illustrative structure depicted in FIG. 6, a heating belt (heating member) 48 is wound around the entire outer peripheral surface of a fixing roller (heating member) 45 having a heat-insulating elastic layer. For this reason, the heat capacity of the heating belt 48 can be reduced, and the warm-up time can be shortened further. In addition to the above illustrative structures, embodiments of the present disclosure are also applicable to various external IH fixing units.

As described above, various embodiments in accordance with the present disclosure adopt a structure in which the heat roller 46 (or the fixing roller 45) and the heating belt 48 are subjected to induction heating by magnetic flux from the induction heating coil 52 provided along the outer surfaces thereof so as to heat and fuse a toner image (external IH). More specifically, the coil bobbin 53, the arch cores 54, and the side cores 56 are similarly arranged along the outer surfaces of the heat roller 46 (or the fixing roller 45) and so on, thereby forming a magnetic path through which the magnetic flux generated by the induction heating coil 52 is guided. The magnetic flux is guided to the arch cores 54 and the side cores 56, and provides for magnetic induction heating on the heating belt 48 and so on.

The side cores 56 and the center core 58 are pressed toward the coil bobbin 53 by the core fixing member 70 via the elastic members 68*s* and 68*e*. That is, the side cores 56 and the center core 58 are fixed in the pressing state to the coil bobbin 53 via the elastic members 68*s* and 68*c* by fastening the core fixing member 70 to the coil bobbin 53. Thus, the side cores 56 and the center core 58 can be fixed to the coil bobbin 53 while the elastic members 68*s* and 68*c* absorb dimensional variations in the side cores 56 and the center core 58 and dampen or otherwise reduce chattering noise that may be produced by the side cores 56 and the center core 58 due to resonance with the magnetic flux. For this reason, the adhesive used to fix the cores to the coil bobbin 53 in the related art is unnecessary, and production efficiency of the fixing unit 14 can be enhanced.

By adopting the arch core holder 72 as an example of the core fixing member 70 and pressing the side cores 56 toward the coil bobbin 53 by the arch core holder 72, the side cores 56 are fixed with the existing structure. Further, since the side cores 56 can be fixed in the pressing state to the coil bobbin 53 via the elastic members 68*s* by fastening the arch core holder 72 to the coil bobbin 53, the side cores 56 are reliably fixed to the coil bobbin 53 without using any adhesive.

Moreover, since the center core 58 is pressed toward the coil bobbin 53 by the arch core holder 72, the center core 58 can be fixed with the existing structure. Further, since the center core 58 can be fixed in the pressing state to the coil bobbin 53 via the elastic members 68*c* by fastening the arch core holder 72 to the coil bobbin 53, the center core 58 can be reliably fixed to the coil bobbin 53 without using any adhesive while the elastic members 68*c* absorb dimensional variation and so on in the center core 58.

By also adopting the shield cover 82 as an example of the core fixing member 70 and pressing the arch cores 54 toward the coil bobbin 53 by the shield cover 82, the arch cores 54 are fixed with the existing structure. Further, since the arch cores 54 can be fixed in the pressing state to the arch core holder 72 via the elastic member 68*a* by fastening the shield cover 82 to the coil bobbin 53, the arch cores 54 can be reliably fixed to the arch core holder 72 without using any adhesive.

Moreover, since the shield cover 82 is provided on the outer side of the arch cores 54, the side cores 56 and the center core 58 are more reliably fixed to the coil bobbin 53 by fastening the shield cover 82 to the coil bobbin 53. Further, since the shield cover 82 and the arch core holder 72 are fastened to the coil bobbin 53 by the screws 91 and the nuts 92, the shield cover 82 and the arch core holder 72 can be fastened to the coil bobbin 53 with a simple structure without using any adhesive.

Since dimensional variations in the cores 54, 56, and 58 are absorbed by the elastic members 68*a*, 68*s*, and 68*e*, a good toner image can be formed with sufficient fixing performance, and reliability of the image forming apparatus 1 is enhanced. The present disclosure is not limited to the above-described embodiments, and various modifications are possible. For example, retching to the structure of the core portion, the present disclosure is applicable to a rotatable center core and a fixed center core.

In the above embodiments, the shield cover 82 is attached to the coil bobbin 53 after the arch core holder 72 is attached to the coil bobbin 53. However, in various embodiments, the arch core holder 72 and the shield cover 82 may be fastened together to the coil bobbin 53. That is, similarly to the arch cores 54, the side cores 56 and the center core 58 may be fixed in the pressing state to the coil bobbin 53 by fastening the shield cover 82 to the coil bobbin 53.

In addition, the shield cover 82 and the arch core holder 72 may be fastened to the coil bobbin 53 by other fastening mechanisms, such as snap fitting, instead of using the screws 91 and the nuts 92. Even when snap fitting is performed by elastic engagement of concave and convex portions, the shield cover 82 and the arch core holder 72 can be fastened to the coil bobbin 53 with a simple structure without using any adhesive.

Further, while the foregoing illustrative embodiments are well-suited for adapting existing structures that currently use adhesive for fixing the parts of the core portion, those skilled in the art will understand in view of the present disclosure that myriad additional embodiments of the present disclosure are not limited to such adaptations of existing structures.

While the image forming apparatus is embodied by the printer in the present embodiments, the image forming apparatus of the present disclosure is also applicable to a multi-functional peripheral, a copying machine, and a facsimile machine. In any case, the cores can be fixed without using any adhesive, similarly to the above.

Having thus described in detail embodiments of the present disclosure, it is to be understood, that the disclosure of the foregoing paragraphs is not to be limited to particular details and/or embodiments set forth in the above description, as many apparent variations thereof are possible without departing from the spirit or scope of the present disclosure.

What is claimed is:

1. A fixing device for fixing a toner image on a recording medium, the fixing device comprising:

a coil disposed along an outer surface of a heating member and being operable to create a magnetic flux for induction heating of the heating member;

a coil holding portion on which the coil is mounted;

a core portion configured to provide for a magnetic path around the coil, the core portion including arch cores that cover an outer side of the coil, the arch cores being disposed opposite the heating member with the coil interposed therebetween and at a plurality of positions spaced in a width direction of the recording medium, and a side core that covers the outer side of the coil between the arch cores and the coil holding portion, and the core portion having at least one first elastic member between the side core and the arch cores such that the arch cores are not in direct pressing contact with the coil holding portion and are coupled to the coil holding portion via the at least one first elastic member and the side core; and a core fixing member configured to press the core portion toward the coil holding portion via at least one elastic member including the at least one first elastic member between the side core and the arch cores;

wherein the core portion is fixed in the pressing state to the coil holding portion by fastening the core fixing member to the coil holding portion.

2. The fixing device according to claim 1, wherein the core fixing member includes an arch core holder provided on the outer side of the coil so as to hold the arch cores and to press the side core toward the coil holding portion.

3. The fixing device according to claim 2, wherein the at least one elastic member is disposed between the side core and the arch core holder.

4. The fixing device according to claim 2, wherein the side core is fixed in the pressing state to the coil holding portion by fastening the arch core holder to the coil holding portion.

5. The fixing device according to claim 2, wherein the core fixing member includes a shield cover provided on an outer side of the arch cores so as to press the arch cores toward the coil holding portion, and wherein the arch cores are fixed in the pressing state to the coil holding portion by fastening the shield cover to the coil holding portion.

6. The fixing device according to claim 5, wherein the at least one elastic member includes at least one third elastic member disposed between the arch cores and the shield cover.

7. The fixing device according to claim 1, wherein the core portion includes a center core provided between the arch cores and the heating member so as to form the magnetic path with the arch cores and the side core, and wherein the core fixing member includes an arch core holder provided on the outer side of the coil so as to hold the arch cores and to press the center core toward the coil holding portion.

8. The fixing device according to claim 7, wherein the at least one elastic member includes at least one second elastic member disposed between the center core and the arch core holder.

9. The fixing device according to claim 7, wherein the center core is fixed in the pressing state to the coil holding portion by fastening the arch core holder to the coil holding portion.

10. The fixing device according to claim 1, wherein the core portion is fixed in the pressing state to the coil holding portion by fastening the core fixing member to the coil holding portion without using an adhesive between the core portion and the coil holding portion.

11. An image forming apparatus comprising:

an image forming section configured to form a toner image;

a transfer unit configured to transfer the toner image formed by the image forming section onto a recording medium; and a fixing device configured to fix the toner image transferred on the recording medium by the transfer unit onto the recording medium, wherein the fixing device comprises:

a coil disposed along an outer surface of a heating member and being operable to generate a magnetic flux for induction heating of the heating member;

a coil holding portion on which the coil is mounted;

a core portion configured to provide for a magnetic path around the coil, the core portion including arch cores that cover an outer side of the coil, the arch cores being disposed opposite the heating member with the coil interposed therebetween and at a plurality of positions spaced in a width direction of the recording medium, and a side core that covers the outer side of the coil between the arch cores and the coil holding portion, and the core portion having at least one first elastic member between the side core and the arch cores such that the arch cores are not in direct pressing contact with the coil holding portion and are coupled to the coil holding portion via the at least one first elastic member and the side core; and a core fixing member configured to press the core portion toward the coil holding portion via at least one elastic member including the at least one first elastic member between the side core and the arch cores;

wherein the core portion is fixed in the pressing state to the coil holding portion by fastening the core fixing member to the coil holding portion.

12. The image forming apparatus according to claim 11, wherein the core fixing member includes an arch core holder provided on the outer side of the coil so as to hold the arch cores and to press the side core toward the coil holding portion.

13. The image forming apparatus according to claim 12, wherein the at least one elastic member is disposed between the side core and the arch core holder.

14. The image forming apparatus according to claim 12, wherein the side core is fixed in the pressing state to the coil holding portion by fastening the arch core holder to the coil holding portion.

15. The image forming apparatus according to claim 12, wherein the core fixing member includes a shield cover provided on an outer side of the arch cores so as to press the arch cores toward the coil holding portion, and wherein the arch cores are fixed in the pressing state to the coil holding portion by fastening the shield cover to the coil holding portion.

16. The image forming apparatus according to claim 15, wherein the at least one elastic member includes at least one third elastic member disposed between the arch cores and the shield cover.

17. The image forming apparatus according to claim 11, wherein the core portion includes a center core provided between the arch cores and the heating member, the center core forming the magnetic path together with the arch cores and the side core, and wherein the core fixing member includes an arch core holder provided on the outer side of the coil so as to hold the arch cores and to press the center core to and the coil holding portion.

18. The image forming apparatus according to claim 17, wherein the at least one elastic member includes at least one second elastic member disposed between the center core and the arch core holder.

19. The image forming apparatus according to claim 17, wherein the center core is fixed in the pressing state to the coil holding portion by fastening the arch core holder to the coil holding portion.

20. The image forming apparatus according to claim 11, wherein the core portion is fixed in the pressing state to the coil holding portion by fastening the core fixing member to the coil holding portion without using an adhesive between the core portion and the coil holding portion.

* * * * *